US006391168B1

(12) United States Patent
Ueno

(10) Patent No.: US 6,391,168 B1
(45) Date of Patent: May 21, 2002

(54) PLATING APPARATUS UTILIZING AN AUXILIARY ELECTRODE

(75) Inventor: Kazuyoshi Ueno, Tokyo (JP)

(73) Assignee: NEC Corporation, Tokyo (JP)

( * ) Notice: Subject to any disclaimer, the term of this patent is extended or adjusted under 35 U.S.C. 154(b) by 0 days.

(21) Appl. No.: 09/542,338

(22) Filed: Apr. 5, 2000

(30) Foreign Application Priority Data

Apr. 6, 1999 (JP) ..... 11-099460

(51) Int. Cl.[7] ..... C25B 9/00; C25C 7/00; C25D 17/00

(52) U.S. Cl. ..... 204/242; 204/224 R; 204/297.01; 204/DIG. 7

(58) Field of Search ..... 204/224 R, DIG. 7, 204/297.01, 297.12, 242; 205/122, 125

(56) References Cited

U.S. PATENT DOCUMENTS

| | | | | |
|---|---|---|---|---|
| 3,862,891 A | 1/1975 | Smith | ..... | 205/96 |
| 4,120,759 A | 10/1978 | Asami et al. | ..... | 205/82 |
| 6,179,983 B1 | 1/2001 | Reid et al. | ..... | 205/96 |

FOREIGN PATENT DOCUMENTS

| | | |
|---|---|---|
| JP | A 59-38397 | 3/1984 |
| JP | U 3-103260 | 10/1991 |
| JP | 8-100292 | 4/1996 |
| JP | 9-157897 | 6/1997 |

*Primary Examiner*—Kathryn Gorgos
*Assistant Examiner*—Wesley A. Nicolas
(74) *Attorney, Agent, or Firm*—Young & Thompson

(57) ABSTRACT

In the plating solution in the plating bath, a wafer and an anode electrode are opposed to each other, between which is interposed a disk-shaped auxiliary electrode having a diameter smaller than that of the wafer. This auxiliary electrode has a plurality of holes formed therein. Through these holes, the plating solution is uniformly supplied to between the wafer and the anode electrode. The auxiliary electrode is supplied with the same positive potential as that of the anode electrode. This forms electric lines of force directed from the auxiliary electrode and the anode electrode to the wafer. The closer provision of the anode electrode (the auxiliary electrode) compensates a drop in current density on the wafer resulting from the potential drop at the portion far from cathode terminals.

8 Claims, 4 Drawing Sheets

PLATING APPARATUS UTILIZING AN AUXILIARY ELECTRODE

BACKGROUND OF THE INVENTION

1. Field of the Invention

The present invention relates to a plating apparatus for applying copper plating or the like to the surface of a wafer in a semiconductor fabrication process.

2. Description of the Related Art

Copper traces in a semiconductor device are fabricated by e.g. damascene, in which copper is embedded into trenches formed in the surface of a semiconductor substrate, to form so-called trenched traces. Here, for the sake of forming a copper layer all over the surface thereof so as to fill the trenches, plating is applied instead of sputtering or the like.

FIG. 1 is a schematic diagram showing a conventional wafer plating apparatus. A plating bath 1 contains a tubular, closed-bottomed partitioning member 2 which is smaller than the plating bath 1. The partitioning member 2 is arranged to be spaced from the plating bath 1. A pipe 10*a* connected to a plating solution supply port of a plating solution circulator 9 is introduced into a space enclosed by the partitioning member 2. The extremity of a pipe 10*b* connected to a plating solution circulation inlet of the plating solution circulator 9 is introduced to a space between the plating bath 1 and the partitioning member 2. By this means, a plating solution 11 is supplied to the inside of the partitioning member 2 before it flows over the top of the partitioning member 2 to the bottom of the plating bath 1.

In the partitioning member 2, an anode electrode 4 is arranged with its surface horizontal via an insulative supporting member 3. Above this anode electrode 4 is arranged a wafer holder 5. This wafer holder 5 fixes a wafer 6 with the surface horizontal so as to face the anode electrode 4. This wafer 6 is in contact with hook-like cathode terminals 7 at several portions. A power supply 8 supplies a negative potential and a positive potential to the cathode terminals 7 and the anode electrode 4, respectively.

In the wafer plating apparatus configured as described above, the plating solution, such as a copper sulfate aqueous solution, is supplied from the plating solution circulator 9 to the inside of the partitioning member 2 through the pipe 10*a*. The plating solution flowing over the top of the partitioning member 2 is returned from the bottom of the plating bath 1 to the plating solution circulator 9 through the pipe 10*b*. Meanwhile, the wafer 6 has a thin copper seed layer formed on its surface by sputtering or the like, before loaded in the plating bath 1. Then, the power supply 8 applies a prescribed voltage across the anode electrode 4 and the wafer 6 (the cathode terminals 7) to form an electric field directed from the anode electrode 4 (+) to the wafer 6 (−). This electric field in the plating solution deposits, for example, copper ion in the plating solution onto the surface of the wafer 6, thereby forming a plating layer on the surface of the wafer 6. The amount of this copper deposition depends on the current densities on the wafer surface.

In this conventional wafer plating apparatus, electric lines of force directed from the anode electrode 4 to the seed layer of the wafer 6 are formed in the region where the anode electrode 4 and the wafer 6 are opposed to each other. These electric lines of force are, however, nonuniform within the surface of the wafer 6, thereby causing unevenness in copper plating thickness. The reason for this is that the cathode terminals 7 and the seed layer of the wafer 6 contact with each other on the periphery of the wafer. The power supply voltage is initially supplied to the seed layer on the periphery of the wafer, and therefore the voltage within the wafer surface becomes nonuniform due to voltage drops in the seed layer. Besides, the configuration of the plating bath and the electrical properties of the plating solution cause a change in the electric field distribution between the anode electrode 4 and the wafer 6. This results in nonuniform current densities within the wafer surface, thereby generating unevenness in plating thickness. Thus, a plating layer thinner at the wafer center and thicker on the wafer periphery is formed on the wafer surface.

This unevenness in plating thickness deteriorates the uniformity of the wiring resistance within the surface when the traces are formed by damascene. Moreover, in the conventional plating apparatus, correction is difficult to make when subtle fluctuations of the plating bath and/or changes of the plating solution deteriorate the uniformity of the plating thickness within the wafer surface.

For the sake of maintaining the plating layer at a constant film thickness, an electroplating method has been proposed in which a shielding electrode is arranged in the vicinity of a cathode electrode, and the electric current flowing from an anode electrode to the cathode electrode and the electric current flowing from the anode electrode to the shielding electrode are supplied by separate constant-current sources (Japanese Patent Laid-Open Publication No.Hei 9-157897).

This method, however, has a problem of lower throughput since some electric current is wasted due to the presence of the current flowing to the shielding electrode, aside from the current for plating an object to be plated.

Moreover, for the purpose of uniformizing the current density distribution within the plating area, a plating-film forming method has been proposed in which a film thickness adjusting plate having an opening is arranged on the paths of the plating currents to narrow the current paths so that the currents to the periphery of an object to be plated take longer paths to prevent the electric field concentration on the periphery of the object to be plated (Japanese Patent Laid-Open Publication No.Hei 8-100292).

However, this method also has the problem of lower throughput because it improves the plating uniformity by reducing the current densities on the area apt to greater plating thicknesses.

SUMMARY OF THE INVENTION

It is thus an object of the present invention to provide a plating apparatus which can create a uniform plating layer on the surface of an object to be plated with high productivity, and can control the electric field in the vicinity of the object to be plated independent of fluctuations of the plating bath and/or changes of the plating solution, so as to control the plating thickness distribution.

A plating apparatus according to the present invention comprises: a plating bath for containing a plating solution; a holder for holding an object to be plated in the plating solution; an electrode opposed to the object to be plated within the plating solution; a first power supply for supplying a negative potential to the object to be plated and a positive potential to the electrode; an electric field adjusting member of conductive material, interposed between the object to be plated and the electrode within the plating solution; and a second power supply for supplying a potential to the electric field adjusting member. Here, the electric field adjusting member adjusts the distribution of the electric lines of force directed from the electrode to the object to be plated, by using the potential supplied from the second power supply.

In this plating apparatus, the electric field adjusting member may be a disk-like auxiliary electrode having a diameter smaller than that of the object to be plated, being interposed between the object to be plated and the electrode. Here, the second power supply supplies a positive potential equal to or lower than that of the electrode to the auxiliary electrode. Besides, the auxiliary electrode preferably has a plating solution hole formed therethrough along the direction of thickness. Moreover, the surface opposed to the object to be plated, of the auxiliary electrode may be configured to rise at the center and sink to the periphery of the auxiliary electrode. In this case, the auxiliary electrode may be thick at the center thereof and thin on the periphery thereof.

Another plating apparatus according to the present invention comprises: a plating bath for containing a plating solution; a holder for holding an object to be plated in the plating solution; an electrode opposed to the object to be plated within the plating solution; and a power supply for supplying a negative potential to the object to be plated and a positive potential to the electrode. Here, the surface opposed to the object to be plated, of the electrode rises at the center thereof toward the object to be plated.

In the present invention, the auxiliary electrode or the like shortens the distance between the center of the object to be plated, apt to smaller plating thicknesses, and the electrode to raise the current density in this area. This increases the electric lines of force in the area, thereby enhancing the uniformity in plating thickness. As a result, a uniform plating layer can be formed with higher productivity.

The nature, principle, and utility of the invention will become more apparent from the following detailed description when read in conjunction with the accompanying drawings.

DETAILED DESCRIPTION OF THE PREFERRED EMBODIMENTS

Figure 1:
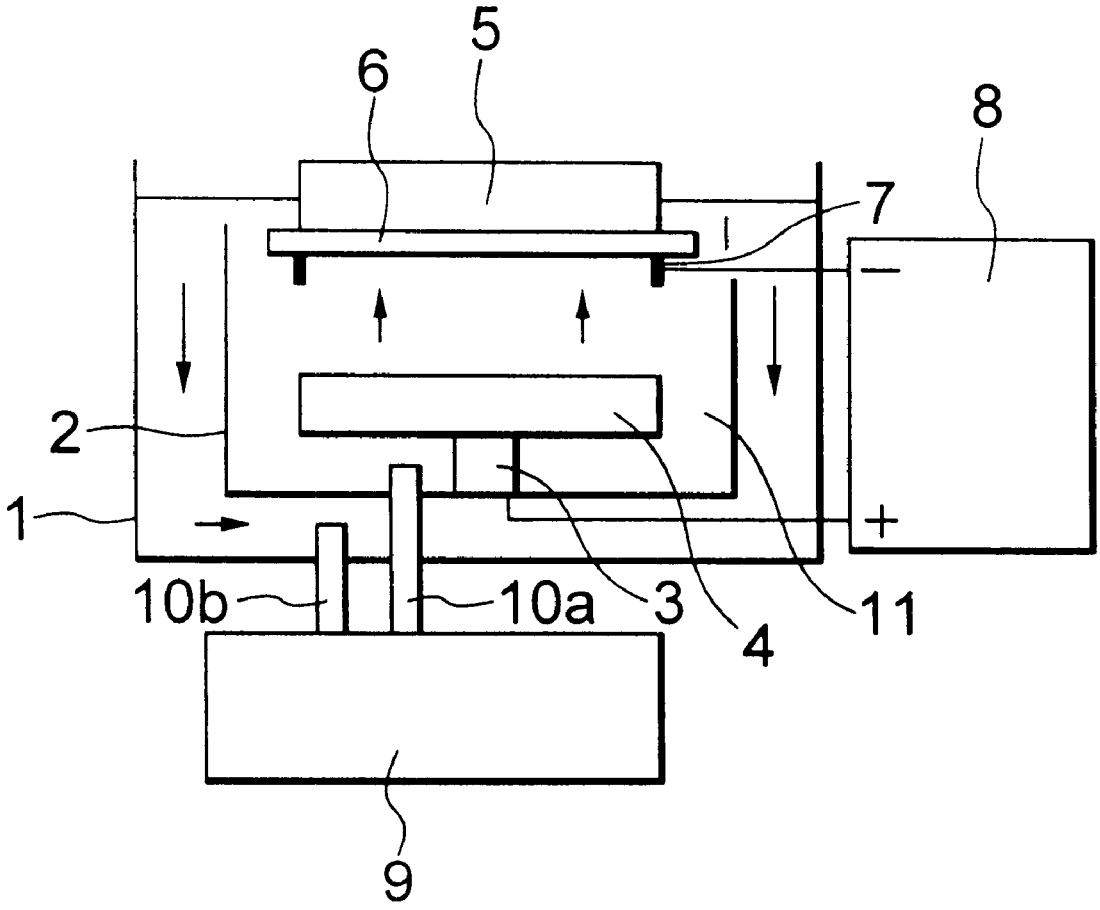
FIG. 1 (PRIOR ART)
FIG. 1 is a diagram showing a conventional plating apparatus.
Figure 2:
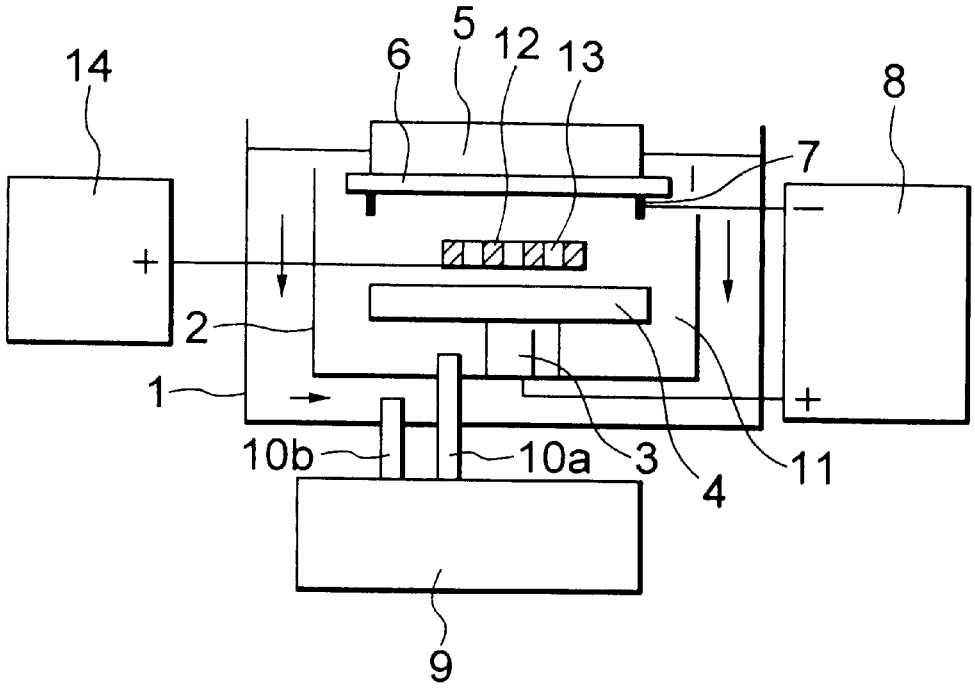
FIG. 2 is a diagram showing the plating apparatus according to a first embodiment of the present invention.

Hereinafter, preferred embodiments of the present invention will be described concretely with reference to the accompanying drawings. FIG. 2 is a diagram showing the plating apparatus according to a first embodiment of the present invention. In FIG. 2, similar component parts to those of FIG. 1 which shows the conventional plating apparatus are designated by the same reference numerals, and detailed description thereof will be omitted. In the present embodiment, an auxiliary electrode 12 as the electric field adjusting member is arranged within a plating solution 11, in the region where a wafer 6 and an anode electrode 4 are opposed to each other.

Figure 3:
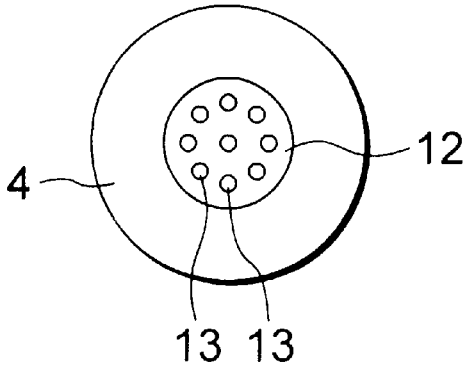
FIG. 3 is a plan view showing the configuration of the auxiliary electrode in the apparatus.

FIG. 3 is a plan view of the anode electrode 4 as seen vertically downward from above the auxiliary electrode 12. As shown in this FIG. 2, the auxiliary electrode 12 is a disk-like conductive member having a diameter approximately half that of the anode electrode 4. The auxiliary electrode 12 is placed with its surface horizontal, with its center coincident with the center of the anode electrode 4. This auxiliary electrode 12 is held by an insulating material (not shown) extended from a partitioning member 2 or the anode electrode 4. The auxiliary electrode 12 has a plurality of holes 13 piercing therethrough along the direction of thickness evenly formed in its surface. Each of these holes 13 has a dimension enough for the plating solution 11 to pass therethrough. Besides, the auxiliary electrode 12 is connected to a second power supply 14 outside the plating bath 1. This second power supply 14 supplies the auxiliary electrode 12 with, e.g., the same positive potential as that on the anode electrode 4. In this connection, the potential on the auxiliary electrode 12 is appropriately set in accordance with the shape of the plating bath 1, the type of the plating solution, and the like. The potential on the auxiliary electrode 12, however, is equal to or lower than the potential on the anode electrode 4.

Next, description will be given of the operation of the plating apparatus configured as described above. In the plating bath 1, the plating solution 11 fed from the plating solution circulator 9 circulates through, in order from the plating solution circulator 9, the pipe 10*a*, the inside of the partitioning member 2, between the partitioning member 2 and the plating bath 1, and the pipe 10*b*.

This plating solution 11 flows through the holes 13 in the auxiliary electrode 12. Therefore, the plating solution 11 is supplied to between the anode electrode 4 and the wafer 6 without its flow being hampered by the auxiliary electrode 12 inside the partitioning member 2.

Meanwhile, the auxiliary electrode 12 is supplied with the same positive potential as that on the anode electrode 4 from the second power supply 14. The wafer 6 is opposed at its central portion of one-half diameter to the auxiliary electrode 12 and at its peripheral, ring-like portion to the anode electrode 4. Then, the current density, i.e. the electric lines of force, between electrodes depends on the distance between the electrodes; that is, shorter distances increase the current density, and longer distances decrease the current density. As a consequence, the center of the wafer 6 receives electric lines of force of relatively high current density from the short-distanced auxiliary electrode 12, and the periphery of the wafer 6 receives electric lines of force of relatively low current density from the long-distanced anode electrode 4. In the conventional plating apparatus of FIG. 1, the electric lines of force to the wafer center were fewer than those to the wafer periphery due to the causes including the drop in voltage in the thin copper seed layer on the wafer 6, the voltage being fed through the cathode terminals 7. On the contrary, in the plating apparatus of the present embodiment of FIG. 2, the electric lines of force to the wafer center are increased by the action of the auxiliary electrode 12 as discussed above. Consequently, the drop in the voltage and the action of the auxiliary electrode compensate each other to uniformize the electric lines of force in density within the surface of the wafer 6. Thus, according to the present embodiment, a plating layer with uniform plating thickness is formed on the wafer surface.

Figure 4:
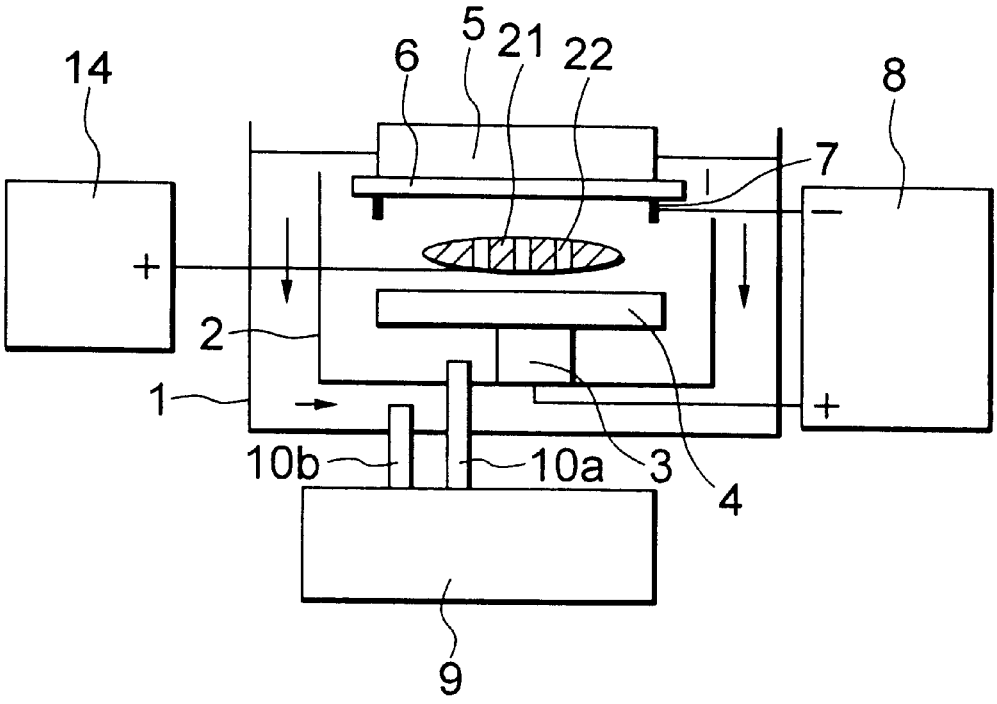
FIG. 4 is a diagram showing the plating apparatus according to a second embodiment of the present invention.
Figure 5:
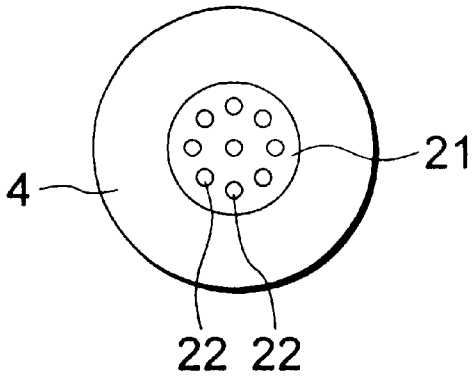
FIG. 5 is a plan view showing the configuration of the auxiliary electrode in the apparatus.

Now, a second embodiment of the present invention will be described with reference to FIG. 4. In this FIG. 4, similar component parts to those of FIG. 2 are designated by the same reference numerals, and detailed description thereof will be omitted here. FIG. 5 is a diagram showing an auxiliary electrode 21 in the present embodiment, as seen vertically downward from above. In the present embodiment, the electric field adjusting member uses the auxiliary electrode 21 radially varying in thickness so as to be thick at the center and get thinner to the periphery. This auxiliary electrode 21 also has a plurality of holes 22 formed therethrough along the direction of thickness. Moreover, this auxiliary electrode 21 is also interposed between a wafer 6 and an anode electrode 4.

In the plating apparatus of the present embodiment configured above, the auxiliary electrode 21 radially varies in thickness even beneath the central region of the wafer 6 opposed to the auxiliary electrode 21. The distance between the surface of the wafer 6 and the surface of the auxiliary electrode 21 therefore increases from the wafer center to the periphery. On this account, the distance between the wafer 6 and the auxiliary electrode 21 is the shortest at the wafer center with the highest current density. As approaches the wafer periphery, the distance from the auxiliary electrode 21 increases to reduce the current density gradually. After the electrode to face the wafer 6 turns from the auxiliary electrode 21 to the anode electrode 4, the distance between the wafer 6 and the electrode becomes yet longer to reduce the current density. Thus, in the present embodiment, the changes in current density due to the causes including the voltage drop in the copper seed layer on the surface of the wafer 6 are compensated with higher reliability even in the region of the wafer 6 opposed to the auxiliary electrode 21. This allows a plating layer to be formed with yet higher uniformity.

Figure 6A:
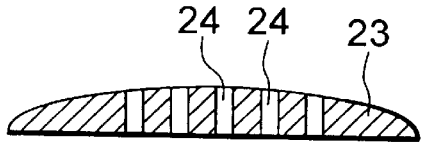
FIGS. 6A and 6B are diagrams showing the configuration of the auxiliary electrode in a third embodiment of the present invention.
Figure 6B:
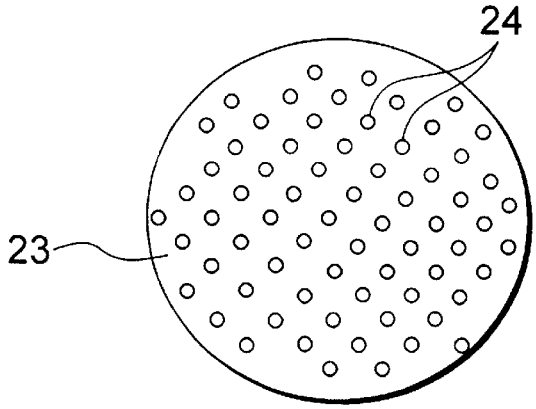

FIGS. 6A and 6B are diagrams showing an auxiliary electrode 23 in a third embodiment of the present invention. The auxiliary electrode as the electric field adjusting member may have such a shape that the bottom surface closer to the anode electrode 4 is flat and the top surface opposed to the wafer 6 rises at its center as shown in FIGS. 6A and 6B, instead of such a shape that both top and bottom surfaces rise at the respective centers as shown in FIG. 4. In addition, a plurality of holes 24 for letting the plating solution therethrough prefer to be distributed all over the auxiliary electrode 23 evenly, as shown in FIG. 6B.

Figure 7:
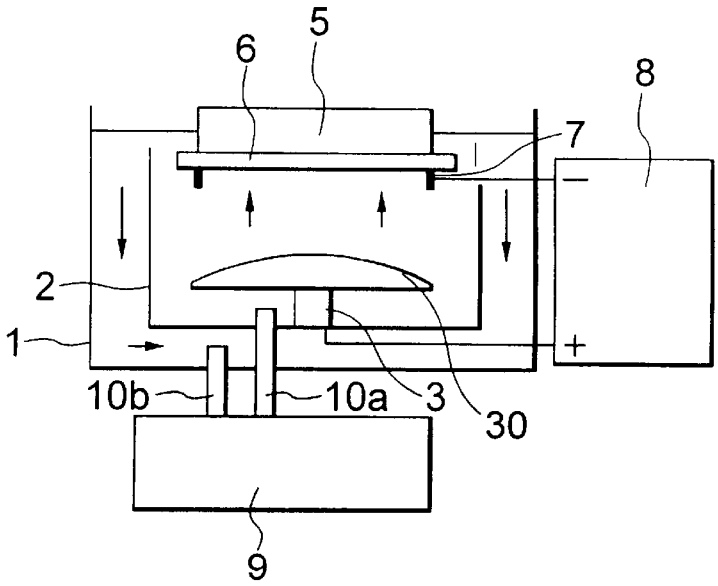
FIG. 7 is a diagram showing the plating apparatus according to a fourth embodiment of the present invention.

FIG. 7 is a diagram showing the plating apparatus according to a fourth embodiment of the present invention. In the present embodiment, it is not an auxiliary electrode but an anode electrode 30 itself that has the top surface, i.e. the surface opposed to a wafer 6, formed into a curved surface rising at the center. The present embodiment requires no auxiliary electrode, whereas an auxiliary electrode may be interposed between the wafer 6 and the anode electrode 30 as in the embodiments shown in FIGS. 2 through 6.

In the present embodiment configured as described above, the opposing surface of the anode electrode 30 is curved so as to be thick at the center thereof and thin on the periphery thereof. Therefore, the distance between the wafer 6 and the anode electrode 30 increases from the center to the periphery. Given that the potential is constant within the surface of the wafer 6, the current density is the highest at the wafer center and the lowest on the wafer periphery. However, as discussed previously, the potential within the wafer surface is nonuniform because of the voltage drop in the copper seed layer on the wafer surface, so that the potential is the lowest at the center of the wafer 6 and the highest on the wafer periphery. Hence, the voltage drop in the seed layer and the change in wafer-to-electrode distance due to the surface configuration of the anode electrode 30 compensate each other to make the current densities on the wafer surface uniform, thereby uniformizing the distribution of the electric lines of force directed from the anode electrode 30 to the wafer 6. This makes it possible to form a plating layer with uniform film thickness.

The present invention is not limited to the foregoing embodiments, and various modifications may be made thereto. The size and shape of the auxiliary electrode, the curve of the wafer opposing surface, and the like may be determined as appropriate so that uniform current densities and uniform electric lines of force are created on the wafer surface, and may be set as appropriate in accordance with the characteristics of the plating apparatus. The auxiliary electrode is not limited to those disks having holes as employed in the foregoing embodiments, and may use various materials such as mesh-like ones. A disk used as the auxiliary electrode is not necessarily provided with the holes for letting the plating solution therethrough. Moreover, the material for the auxiliary electrode has only to be conductive, and further prefers to be nonreactive with the plating solution. On this account, the use of Pt is preferable, whereas other materials such as a copper alloy containing P on the order of 0.4% by weight may also be used.

Furthermore, the power supply 14 and the power supply 8 need not be separated from each other. The plating apparatuses may be configured so that the anode potential from the power supply 8 is simply supplied to the auxiliary electrode, or the anode potential from the power supply 8 is stepped down before supplied to the auxiliary electrode.

According to the present invention, the electric field adjusting member is interposed between the object to be plated and the electrode, and the electric field on the surface of the object to be plated is adjusted so that the surface of the object to be plated becomes uniform in current density. Therefore, even if the potential on the surface of the object to be plated is nonuniform for some reasons including that the potential is applied to the surface of the object to be plated at the periphery of the object to be plated, it is possible to form uniform electric lines of force within the surface of the object to be plated so as to uniformize the film thickness of the plating layer. In addition, even if fluctuations of the plating bath or changes of the plating solution occur, the present invention facilitates the electric field control in the vicinity of the object to be plated, thereby allowing the control to the distribution of plating thickness.

While there has been described what are at present considered to be preferred embodiments of the invention, it will be understood that various modifications may be made thereto, and it is intended that the appended claims cover all such modifications as fall within the true spirit and scope of the invention.

What is claimed is:

1. A plating apparatus comprising:

a plating bath for containing a plating solution;

a holder for holding an object to be plated in the plating solution;

an electrode opposed to said object to be plated within the plating solution;

a first power supply for supplying a negative potential to said object to be plated and a positive potential to said electrode;

an electric field adjusting member of conductive material directly between said object to be plated and said electrode within the plating solution and within electric lines of force that extend from said electrode to said object; and a second power supply for supplying a potential to said electric field adjusting member, wherein said electric field adjusting member adjusts the distribution of the electric lines of force directed from said electrode to said object to be plated, by using the potential supplied from said second power supply, and wherein said electric field adjusting member is a disk-shaped auxiliary electrode having a diameter smaller than that of said object to be plated and is directly between said object to be plated and said electrode, and wherein said second power supply supplies said auxiliary electrode with a positive potential equal to or lower than that of said electrode.

2. The plating apparatus according to claim 1, wherein said auxiliary electrode has a plating solution hole formed therethrough along the direction of thickness.

3. The plating apparatus according to claim 2, wherein the surface opposed to said object to be plated, of said auxiliary electrode rises at the center thereof and sinks to

4. The plating apparatus according to claim 2, wherein said auxiliary electrode is thick at the center thereof and thin on the periphery thereof.

5. The plating apparatus according to claim 1, wherein the surface opposed to said object to be plated, of said auxiliary electrode rises at the center thereof and sinks to the periphery of said auxiliary electrode. the periphery of said auxiliary electrode.

6.The plating apparatus according to claim 1, wherein said auxiliary electrode is thick at the center thereof and thin on the periphery thereof.

7. The plating apparatus of claim 1, wherein said electric field adjusting member is concentric with said electrode.

8. A plating apparatus comprising:

a plating bath for containing a plating solution;

a holder for holding an object to be plated in the plating solution;

an electrode opposed to said object to be plated within the plating solution; and a power supply for supplying a negative potential to said object to be plated and a positive potential to said electrode, wherein the surface opposed to said object to be plated, of said electrode rises at the center thereof toward said object to be plated.

* * * * *